US008696077B2

(12) United States Patent
Huang et al.

(10) Patent No.: US 8,696,077 B2
(45) Date of Patent: Apr. 15, 2014

(54) SLIDE-TRACK BUFFERING DEVICE WITH A SMOOTHLY SLIDING CARRIAGE

(75) Inventors: Kuo-Sheng Huang, New Taipei (TW); I-Hsiang Chiu, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 13/617,094

(22) Filed: Sep. 14, 2012

(65) Prior Publication Data

US 2014/0079347 A1 Mar. 20, 2014

(51) Int. Cl.
*A47B 95/00* (2006.01)

(52) U.S. Cl.
USPC ..... 312/333; 312/319.1

(58) Field of Classification Search
USPC ..... 312/319.1, 333, 334.7, 334.8, 334.44, 312/334.47
See application file for complete search history.

(56) References Cited

U.S. PATENT DOCUMENTS

| | | | | |
|---|---|---|---|---|
| 7,244,005 | B1 * | 7/2007 | Lu | 312/333 |
| 7,374,261 | B1 * | 5/2008 | Wang | 312/333 |
| 7,878,606 | B2 * | 2/2011 | Chen et al. | 312/333 |
| 7,914,093 | B2 * | 3/2011 | Huang | 312/333 |
| 8,079,653 | B2 * | 12/2011 | Huang | 312/333 |
| 8,118,378 | B2 * | 2/2012 | Wei et al. | 312/333 |
| 8,132,873 | B2 * | 3/2012 | Yang | 312/333 |
| 8,240,788 | B2 * | 8/2012 | Juan et al. | 312/333 |
| 8,393,693 | B2 * | 3/2013 | Juan et al. | 312/333 |
| 8,459,758 | B2 * | 6/2013 | Rechberg et al. | 312/333 |
| 8,511,764 | B1 * | 8/2013 | Chen | 312/333 |
| 2009/0140621 | A1 * | 6/2009 | Yang | 312/319.1 |
| 2009/0278430 | A1 * | 11/2009 | Liang et al. | 312/319.1 |

FOREIGN PATENT DOCUMENTS

| | | |
|---|---|---|
| TW | M396049 | 1/2011 |

* cited by examiner

*Primary Examiner* — Matthew Ing
(74) *Attorney, Agent, or Firm* — Muncy, Geissler, Olds & Lowe, P.C.

(57) ABSTRACT

A slide-track buffering device with a smoothly sliding carriage comprising: a control stand on which there are a guide plate extending forward, a guide chute at the rear part of the guide plate, and a beveled resisting groove in front of the guide chute; a slide carriage sliding on and covering the guide plate and comprising a shorter first area in the back, a locator under the first area, and an accommodating groove in front of the locator; at least a spring unit linking between the control stand and the slide carriage; a swing member which is held in the accommodating groove and located between the slide carriage and the control stand and is provided with a joint hole in the back and a boss underneath in order to engage the locator with the joint hole, accommodate the boss in the guide chute and embody superior smoothness and actuation.

9 Claims, 5 Drawing Sheets

SLIDE-TRACK BUFFERING DEVICE WITH A SMOOTHLY SLIDING CARRIAGE

BACKGROUND OF THE INVENTION

1. Field of the Invention

The present invention relates to a slide-track structure, particularly a slide-track buffering device with a smoothly sliding carriage which depends on the slide carriage's front elongated size for sliding and buffering and promotes smoothness and stability of actuated slide tracks.

2. Description of the Related Art

Cabinet lockers or drawers have been extensively applied in various storage implements. To realize a cabinet locker (drawer) which is conveniently pulled out, those slide tracks with functions for positioning and guidance are usually integrated into both laterals of a cabinet locker (drawer). For stable and quiet close of a cabinet locker, the slide tracks are further integrated with a homing-and-buffering mechanism which takes advantage of a buffer action to prevent the cabinet locker from strong collision or noise and keep its longer service life and better operational quality when the cabinet locker is completely pushed in. As shown in FIG. 1, the automatic homing technology adopted in prior slide tracks comprises: a bottom track 90, a central track 91 and an inner track 92 which can slide successively; a control stand 93 fixed at a rear part of the bottom track 90, a buffering member 931 under the control stand 93, two springs 932, and a guide plate 933 extending forward and provided with a beveled groove 934 in the front; a front slide carriage 94 sliding on and held in a guide plate 933 of the control stand 93 and allowing its front end to link the buffering member 931 as well as the springs 932 wherein the buffering member 931 has a forward-extending buffer pole (not shown in the figure) engaging the front slide carriage 94 on which there is an actuating groove 941 opened; a swing member 95 held in the actuating groove 941 of the front slide carriage 94, dragged to slide on the guide plate 933 of the control stand 93, and deflected in the beveled groove 934; a linking member (not shown in the figure) fixed in the inner track 92 and driven in conjunction with the swing member 95 for effective automatic homing on slide tracks.

However, the abovementioned prior art, which realizes an automatic homing function, is regarded as an unideal design with the unstable front slide carriage 94 as a main body for actuation of slides due to the control stand 93 larger than the front slide carriage 94 for arrangement of the buffering member 931. Furthermore, the prior art features the front slide carriage 94 with a buffer pole engaged in order to establish an action relative to the buffering member 931 on the control stand 93 and generate a buffer effect, that is, the thinner buffer pole as a main body for thrust buffering fails in better smoothness and sensitivity and needs to be corrected. Against this background, it has become a critical issue to correct and get over drawbacks in the prior art for an automatic homing track device by persons skilled in the industry.

Accordingly, the inventor having considered drawbacks or an imperfect structural design of the prior art for an automatic homing track device and attempted to optimize a slide-track buffering device with a smoothly sliding carriage featuring stability, smoothness and practicability has studied and developed the present invention for serving the general public and promoting development of the industry.

SUMMARY OF THE INVENTION

The present invention is intended to provide a slide-track buffering device with a smoothly sliding carriage which is able to take advantage of a slide carriage's front elongated size as well as component arrangement to complete preferred applications contributing to an automatic homing action or actuation superiorly smooth and promotes a product's practicability and competitiveness.

To reach the above purposes, the present invention adopts the following technical measures: a control stand on which there are a baseplate, a guide plate extending forward from the baseplate, a guide chute at the guide plate's rear part, and a beveled resisting groove at the guide chute's front part; a slide carriage which slides on and covers the guide plate and comprises a shorter first area in the back as well as a longer second area in the front wherein the first area is provided with a locator underneath and an accommodating groove in front of the locator and the second area is provided with a protective guide plate opposite to the guide chute; at least a spring linking between the control stand and the slide carriage; at least a buffering member fixed on the slide carriage and provided with a buffer pole protruding backward for engaging the buffer pole's rear tip with the control stand; a swing member which is held in the accommodating groove and located between the slide carriage and the control stand and provided with (a) a joint hole in the back and a boss underneath wherein the joint hole allows the locator to be held inside and the boss slides and is held in the guide chute and (b) a first guide shoe and a central thrust pad which are located at one flank and separated in order and correspond to the accommodating groove.

For technical features and effects in terms of the present disclosure completely understood and recognized, the preferred embodiments and detailed drawings are described hereinafter.

DETAILED DESCRIPTION OF THE PREFERRED EMBODIMENTS

Referring to FIGS. 2 and 3 which illustrate the present invention of a slide-track buffering device with a smoothly sliding carriage wherein the slide-track buffering device comprises a bottom track 80, a central track 81 and an inner track 82: the bottom track 80 is fixed on a cabinet locker (not shown in the figures) and provided with two hold-down grooves 801 distributed at its rear sides; the central track 81 slides on and is held in the bottom track 80; the inner track 82 which slides on and is held in the central track 81 is fixed on a drawer or a cabinet locker (not shown in the figures) and equipped with a raised linking member 821 such as a protruding shaft at the inner rear part.

The present invention of a slide-track buffering device with a smoothly sliding carriage further comprises main components as follows:

(a) A control stand 10: The control stand 10 is provided with a baseplate 11, an end sheet 110 at the rear end, two lateral plates 111 at both sides and two fixed retainers 113, each of which is located at one flank of the baseplate 11 and corresponds to and engages the hold-down groove 801 on the bottom track 80, wherein the baseplate 11 is provided with a buffering fastener 114 at the front end on which there is a mounting hole 115 opened and the lateral plate 111 is designed to have a clamp part 112 inside. Furthermore, the control stand 10 (baseplate 11) is provided with a forward-extending guide plate 13, a guide chute 131 located at the rear part of the guide plate 13, and fixing bores 133 opened at the front part of the guide plate 13 and used to fix the front part of the guide plate 13 (control stand 10) on the bottom track 80;

the guide chute 131 is opposite to a beveled resisting groove 132 ahead; the buffering fastener 114 is located at the lateral side of the guide plate 13.

(b) A slide carriage 20: The slide carriage 20 which slides on and covers the guide plate 13 is equipped with two lateral plates 21, two trajectory chutes 22 inside the lateral plates 21, and a protective guide plate 24 between the trajectory chutes 22 wherein the trajectory chutes 22 provide spaces in which the inner track 82 slides and is shifted, the protective guide plate 24 which correspondingly covers the guide plate 13 of the control stand 10 is designed to have an accommodating groove 26 in the back and coordinates one of the trajectory chutes 22 for development of a buffer accommodating groove 27 therein that is opposite to the buffering fasteners 114 on the control stand 10; furthermore, the lateral plate 21 is equipped with a curved spring guard 23 extending outward, the slide carriage 20 is provided with a raised locator 25 at the rear part, and the accommodating groove 26 adjoins and is located in front of the locator 25.

(c) A spring unit 30 and a buffering member 40: The spring unit 30 comprises two spring grooves 31, each of which is designed to have spring ends 311, 312 at front and rear ends, wherein the spring end 311 and the spring end 312, which are coupled with the clamp part 112 of the control stand 10 and the spring guard 23 of the slide carriage 20 respectively, allow the spring groove 31 to link between the control stand 10 and the slide carriage 20 and supply resilient traction; the buffering member 40 used to engage the buffer accommodating groove 27 comprises a buffer pole 41 which protrudes backward and is provided with a joint end 411 at the rear tip so that the joint end 411 engages the mounting hole 115 on the buffering fastener 114 and makes the buffering member 40 link between the control stand 10 and the slide carriage 20 for the purpose of a buffer action.

In an overall design, the slide carriage 20 with an area larger than that of the control stand 10 presents an elongated shape or a considerable length. As shown in FIG. 3, the slide carriage 20 comprises a shorter first area 20A in the back and a longer second area 20B in the front wherein the first area 20A and the second area 20B are used to accommodate the locator 25 along with the accommodating groove 26 and the protective guide plate 24 along with the buffering member 40, respectively.

(d) A swing member 50: The swing member 50 corresponding to the accommodating groove 26 and locating between the slide carriage 20 and control stand 10 is designed to have a joint hole 51 at the rear part and a boss 52 at the bottom (FIG. 3) wherein the joint hole 51 allows the locator 25 of the slide carriage 20 to be engaged and the boss 52 slides and is held in the guide chute 131 of the control stand 10 (guide plate 13); the swing member 50 is provided with a first guide shoe 53, a central thrust pad 54 and a second guide shoe 55 which are located at one flank and separated in order and correspond to the accommodating groove 26, that is, the central thrust pad 54 is located between the first guide shoe 53 and the second guide shoe 55 for development of at least a guide groove 56 between the central thrust pad 54 and the first guide shoe 53.

Referring to FIGS. 4A, 4B, and 4C which illustrate the present invention of a slide-track buffering device with a smoothly sliding carriage in service: The inner track 82 which is pulled out and slides forward in conjunction with a drawer (or cabinet locker) also makes the linking member 821 of the inner track 82 enter into the inlet of the guide groove 56 on the swing member 50, further driving the central thrust pad 54 to shift both the swing member 50 and the slide carriage 20 forward; the swing member 50 depends on at least the boss 52 to slide forward along the guide chute 131 on the guide plate 13 so that both the spring unit 30 and the buffering member 40 are pulled out. The swing member 50 which slides in conjunction with the slide carriage 20 and arrives at the beveled resisting groove 132 on the guide plate 13 is deflected under effect of a pulling force and results in the linking member 821 on the inner track 82 departing from the central thrust pad 54 (swing member 50) and continuing forward movement, that is, the inner track 82 separates from the slide carriage 20. The swing member 50 deflected and entering into the beveled resisting groove 132 resists the beveled resisting groove 132 and keeps immobile temporarily under effect of a pulling force from the spring unit 30. Finally, the drawer or the cabinet locker will be completely pulled out with the inner track 82 continuing forward movement and pulling the central track 81.

During an operation to pull the abovementioned drawer (or cabinet locker) out, the central track 81 on which the inner track 82 is sliding is driven to further move by the inner track 82 or the activated slide carriage 20 until the drawer (or cabinet locker) is totally pulled out. Referring to FIGS. 5A, 5B and 5C: When the inner track 82 and the central track 81 are pushed backward in conjunction with the drawer (or cabinet locker) and retracted one after another, the linking member 821 which is pulled backward by the inner track 82, enters into the lateral side of the swing member 50, and correspondingly contacts the first guide shoe 53 of the swing member 50 will actuate the swing member 50 to revolve and separate it from control of the beveled resisting groove 132; meanwhile, the slide carriage 20 pulled backward by the spring unit 30 allows the swing member 50, the inner track 82 and the central track 81 to be moved rearward synchronously and complete automatic homing as the boss 52 of the swing member 50 is directed into the guide chute 131 of the guide plate 13. Moreover, the buffering member 40 synchronously pressing the buffer pole 41 backward is able to bring a buffer action moderating sudden close into play so that a drawer (or cabinet locker) completes automatic homing-and-buffering with the slide carriage 20 positioned at the end sheet 110 of the control stand 10.

The present invention takes advantage of relationships of spaces or sizes between the slide carriage 20 and the control stand 10, i.e., spaces of an elongated slide carriage and component arrangement, to guide/buffer an assembly and establish preferred applications which is of service to an automatic homing action or actuation superiorly smooth and promotes a product's practicability and competitiveness.

It can be seen from the above descriptions that the present invention significantly meets patentability and is applied for the patent. However, the above descriptions present preferred embodiments only which do not limit the scope of the present invention; any equivalent change or improvement based on shapes, structures, features and spirit mentioned in the present invention should be incorporated in claims of the present invention.

BRIEF DESCRIPTION OF THE DRAWINGS

FIG. 5A is a first schematic view for the present invention which is pushed in.

FIG. 5B is a second schematic view for the present invention which is pushed in.

FIG. 5C is a third schematic view for the present invention which is pushed in.

Figure 1:
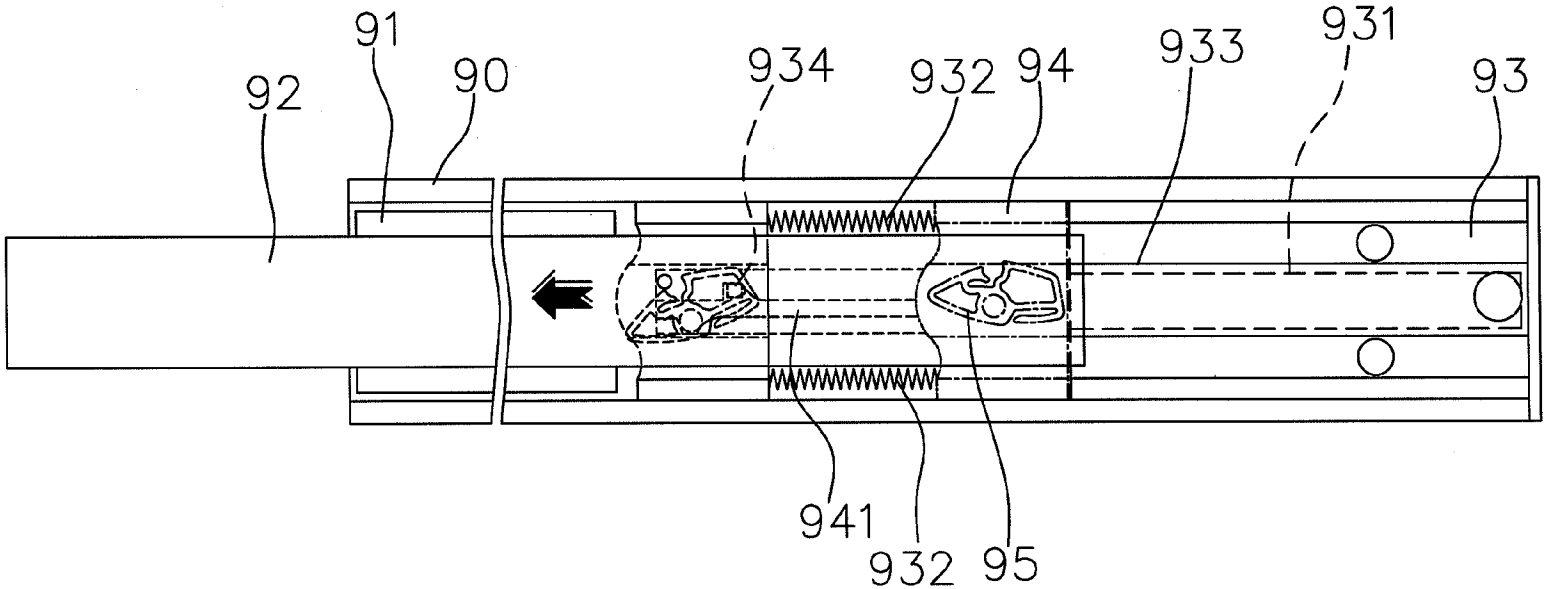
FIG. 1 Prior Art
FIG. 1 is a schematic view for the structure of a slide track based on prior arts.
Figure 2:
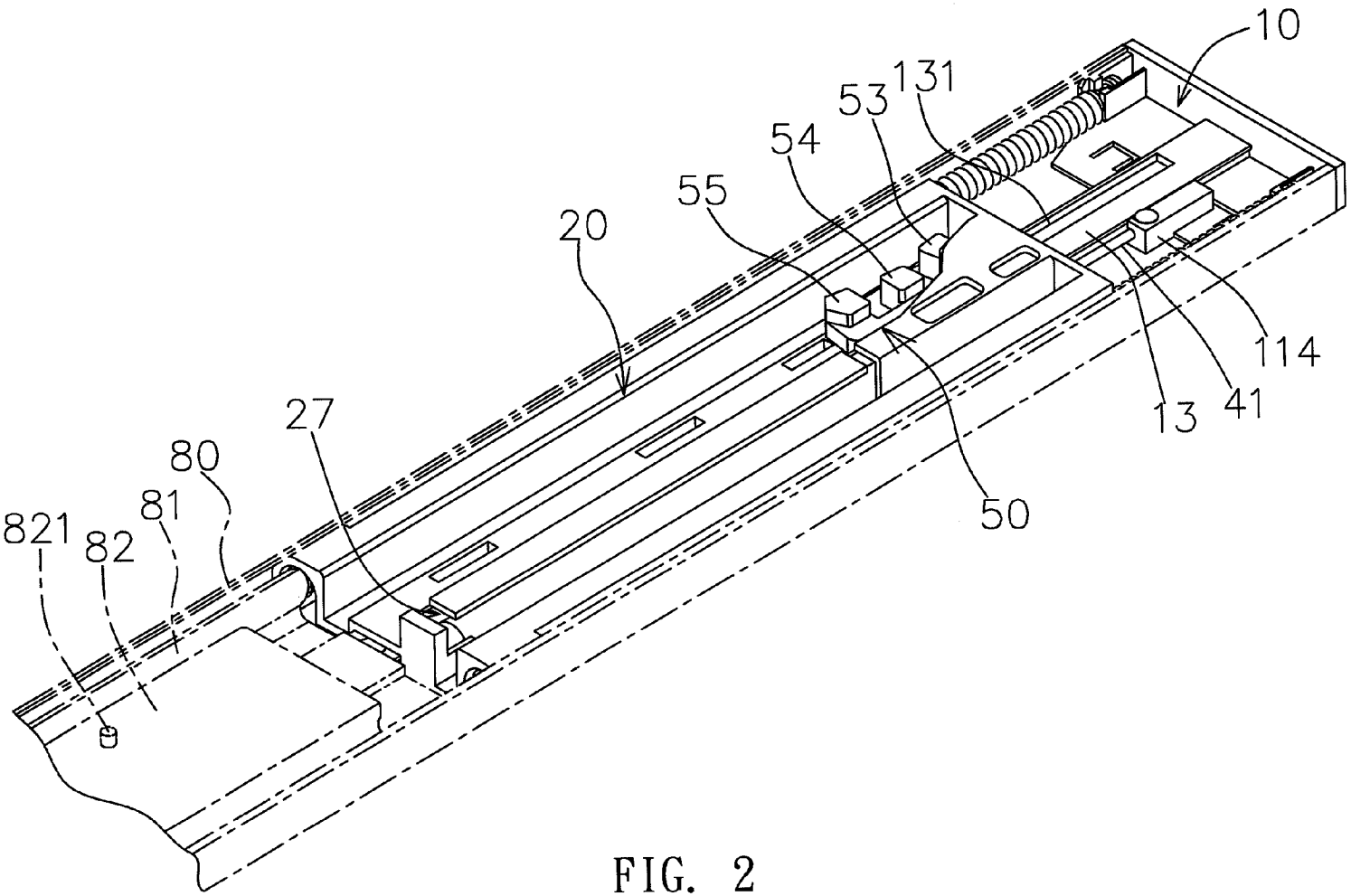
FIG. 2 is a schematic perspective view of the present invention.
Figure 3:
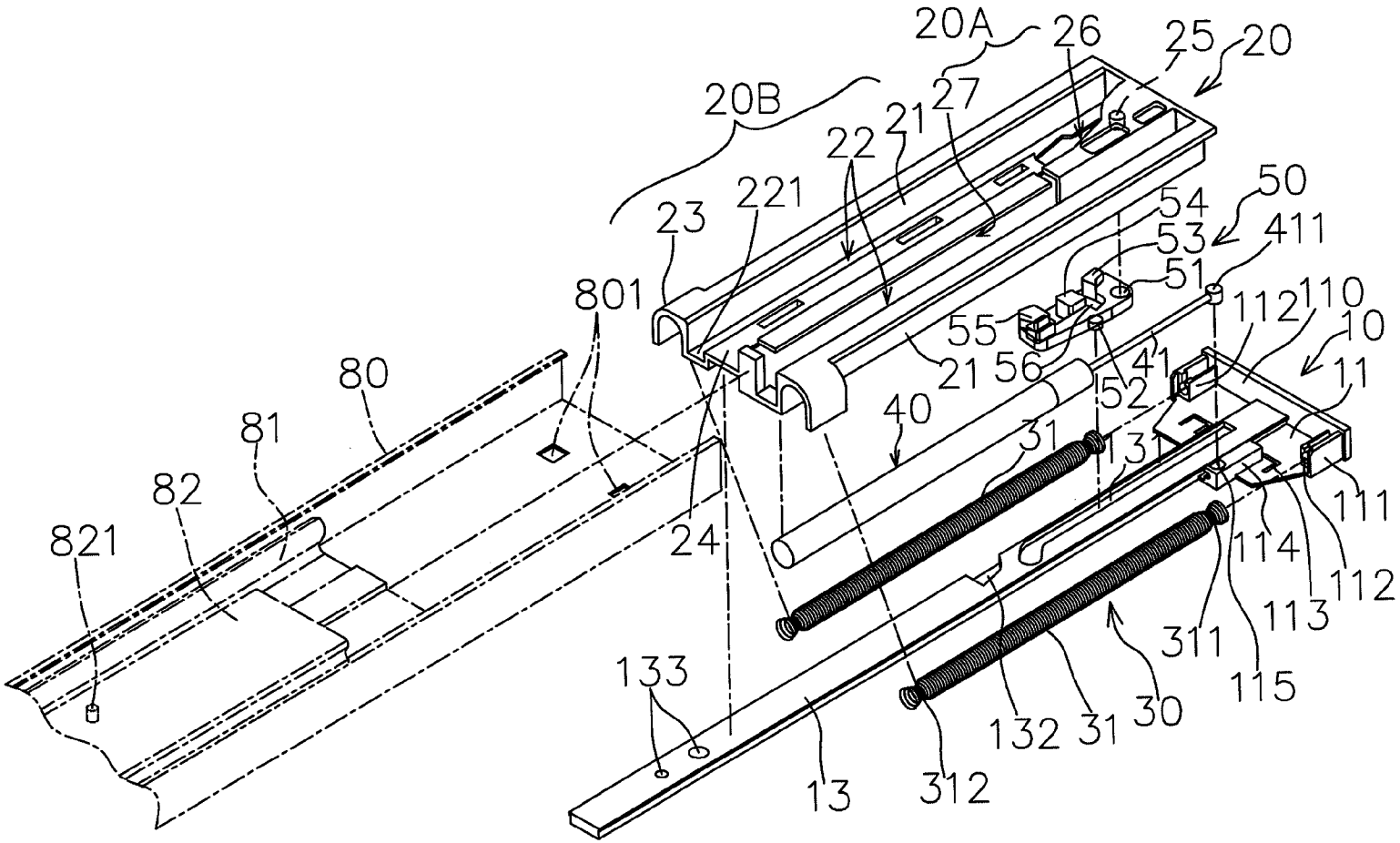
FIG. 3 is a schematic exploded view of the present invention.
Figures 4A, 4B, 4C:
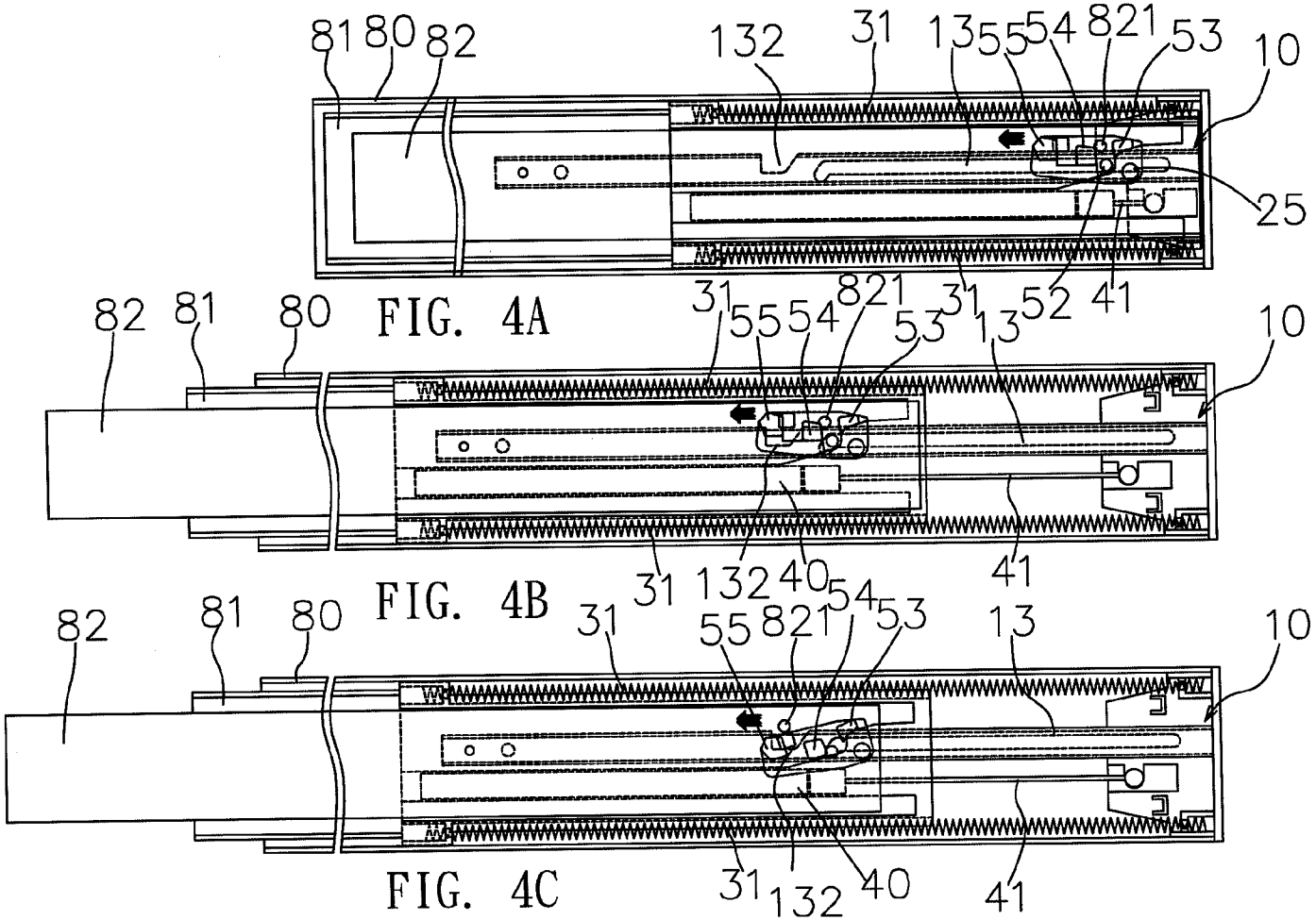
FIG. 4A is a first schematic view for the present invention which is pulled out.
FIG. 4B is a second schematic view for the present invention which is pulled out.
FIG. 4C is a third schematic view for the present invention which is pulled out.
Figures 5A, 5B, 5C:
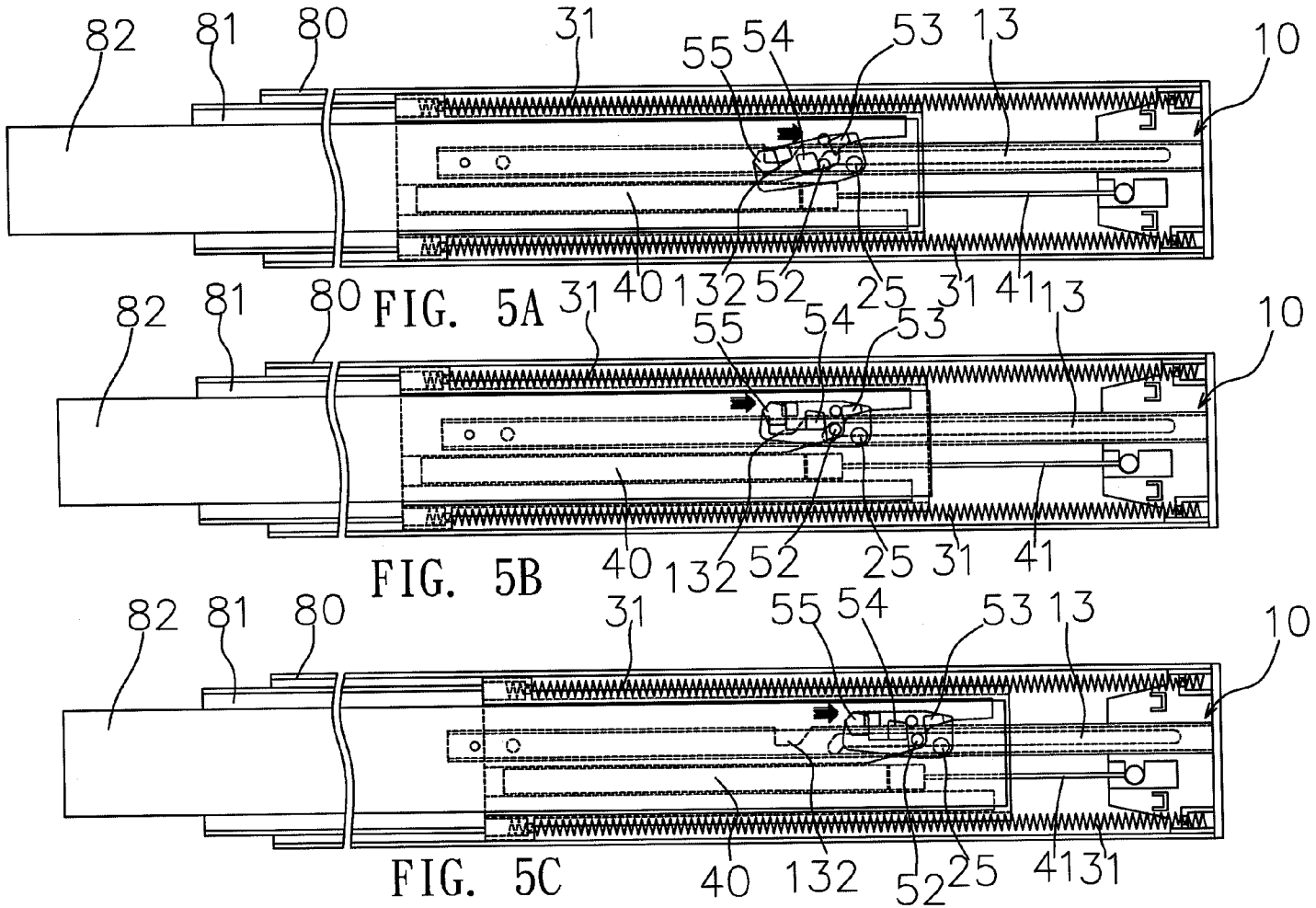

What is claimed is:

1. A slide-track buffering device with a smoothly sliding carriage, comprising:

a control stand on which there are a baseplate, a guide plate extending forward from said baseplate, a guide chute at said guide plate's rear part, and a beveled resisting groove at said guide chute's front part;

a slide carriage which slides on and covers said guide plate and comprises a shorter first area in the back as well as a longer second area in the front wherein said first area is provided with a locator underneath and an accommodating groove in front of said locator and said second area is provided with a protective guide plate opposite to said guide chute;

at least a spring linking between said control stand and said slide carriage;

at least a buffering member fixed on said slide carriage and provided with a buffer pole protruding backward for engaging said buffer pole's rear tip with said control stand;

a swing member which is held in said accommodating groove and located between said slide carriage and said control stand and provided with (a) a joint hole in the back and a boss underneath wherein said joint hole allows said locator to be held inside and said boss slides and is held in said guide chute and (b) a first guide shoe and a central thrust pad which are located at one flank and separated in order to correspond to the accommodating groove wherein said swing member is further provided with a second guide shoe in front of said central thrust pad for development of a guide groove between said central thrust pad and said first guide shoe.

2. The slide-track buffering device with a smoothly sliding carriage according to claim 1 wherein said baseplate is equipped with an end sheet in the back and lateral plates as well as fixed retainers at both sides.

3. The slide-track buffering device with a smoothly sliding carriage according to claim 2 wherein said baseplate is provided with a buffering fastener which is located at one flank of said guide plate and said buffering fastener has a mounting hole thereon for engagement of said buffer pole.

4. The slide-track buffering device with a smoothly sliding carriage according to claim 2 wherein said each of the lateral plates is provided with a clamp part inside for engagement of said spring.

5. The slide-track buffering device with a smoothly sliding carriage according to claim 1 wherein said slide carriage is provided with lateral plates at both sides for development of a trajectory chute inside said each of the lateral plates.

6. The slide-track buffering device with a smoothly sliding carriage according to claim 5 wherein said each of the lateral plates is provided with a curved spring guard extending outward for engaging said spring's one end with said spring guard.

7. The slide-track buffering device with a smoothly sliding carriage according to claim 5 wherein said protective guide plate is provided with a buffer accommodating groove at one side which is used to hold said buffering member and located in said second area.

8. The slide-track buffering device with a smoothly sliding carriage according to claim 1 wherein said control stand is fixed on the rear end of a bottom track on which there are a central track installed, said central track is provided with an inner track sliding thereon, and said inner track is equipped with a raised linking member at an inner rear part.

9. The slide-track buffering device with a smoothly sliding carriage according to claim 8 wherein said bottom track is provided with hold-down grooves at two rear parts and said guide plate is equipped with fixing bores in the front for engagement of said bottom track.

* * * * *